US012677969B2

(12) United States Patent
Waterhouse

(10) Patent No.: US 12,677,969 B2
(45) Date of Patent: Jul. 14, 2026

(54) CUP HOLDING UNIT

(71) Applicant: Jess Allen Waterhouse, Goshen, IN (US)

(72) Inventor: Jess Allen Waterhouse, Goshen, IN (US)

( * ) Notice: Subject to any disclaimer, the term of this patent is extended or adjusted under 35 U.S.C. 154(b) by 0 days.

(21) Appl. No.: 18/987,442

(22) Filed: Dec. 19, 2024

(65) Prior Publication Data

US 2025/0204708 A1 Jun. 26, 2025

Related U.S. Application Data

(60) Provisional application No. 63/613,573, filed on Dec. 21, 2023.

(51) Int. Cl.
*A47G 23/03* (2006.01)

(52) U.S. Cl.
CPC ..... *A47G 23/0316* (2013.01)

(58) Field of Classification Search
CPC ..... A47G 23/0316; A47G 23/03; A47G 23/0633; B65D 25/22; B65D 25/20; B65D 21/0233; B65D 1/36; B65D 1/34
USPC ..... 220/574, 737, 738, 483, 480, 23.89, 220/23.87, 23.86, 23.83; 206/563, 562, 206/564, 565
See application file for complete search history.

(56) References Cited

U.S. PATENT DOCUMENTS 533,584 A * 2/1895 Easley ..... A47J 19/023 99/507
2,003,521 A * 6/1935 Smith ..... A47J 43/1006 D7/665
3,542,280 A * 11/1970 Crabtree ..... B65D 1/34 D7/553.4
6,152,362 A * 11/2000 Rosenfeld ..... B65D 25/20 229/906
7,731,144 B2 6/2010 Kazyaka
9,963,059 B2 5/2018 Cooper et al.
10,010,203 B1 * 7/2018 Vaughn ..... A47G 23/03
10,624,482 B2 4/2020 Boak et al.
(Continued)

FOREIGN PATENT DOCUMENTS

GB 2276531 A * 10/1994 ..... A47G 19/065
JP H0870975 A 3/1996
KR 20200144411 A 12/2020

OTHER PUBLICATIONS

Guidepost Montessori, Water Pouring Retrieved from the Internet: https://www.guidepostmontessori.com/blog/encyclopedia-water-pouring, 5 pages, Jul. 5, 2022.
(Continued)

*Primary Examiner* — Robert J Hicks
(74) *Attorney, Agent, or Firm* — Woodard, Emhardt, Henry, Reeves & Wagner, LLP

(57) ABSTRACT

A cup holding unit for catching spills while pouring. The cup holding unit includes a cup holder, a basket, and a body. The cup holder is configured to hold a cup. The body defines a cavity surrounding the cup holder. The basket is positioned in the cavity and is removable. The basket and/or the cavity catch liquids that spill when pouring into the cup. The basket is removable to allow a user to empty the caught liquid and to clean the basket. The cup holding unit includes one or more suction cups that secure the cup holding unit to a table or another surface during pouring.

19 Claims, 14 Drawing Sheets

(56) References Cited

U.S. PATENT DOCUMENTS

| | | | | |
|---|---|---|---|---|
| 10,974,636 | B2 | 4/2021 | Yumura et al. | |
| 2002/0195371 | A1* | 12/2002 | Brown | A47G 23/0641 206/564 |
| 2009/0277809 | A1* | 11/2009 | Neidhardt | B65D 77/245 220/254.1 |
| 2014/0246447 | A1* | 9/2014 | Wenceslao | B65D 25/22 220/737 |
| 2016/0054049 | A1* | 2/2016 | Harvie | B65D 51/1683 206/562 |
| 2023/0068457 | A1 | 3/2023 | Wu | |
| 2023/0078789 | A1* | 3/2023 | Ridgway | B65D 25/20 220/483 |

OTHER PUBLICATIONS

RAM Mounts, RAM Twist-Lock Suction Cup with Drink Cup Holder Retrieved from the Internet: https://rammount.com/products/rap-224-429, 3 pages, Sep. 28, 2022.

* cited by examiner

CUP HOLDING UNIT

CROSS REFERENCE TO RELATED APPLICATIONS

This application claims the benefit of U.S. Patent Application No. 63/613,573, filed Dec. 21, 2023, which is hereby incorporated by reference.

BACKGROUND

Toddlers and young children generally develop various skills, particularly motor skills, through trial and error. Such trial and error can involve practice in the form of ordinary daily activities, exposure to new activities, and/or deliberate practice scenarios among other examples. Because toddlers have limited motor skills, this type of practice can result in objects being dropped or knocked over. This can lead to such objects being broken and various messes being created. For example, when learning to pour water and other beverages from a pitcher into a glass, toddlers can cause messes by spilling beverages, dropping the pitcher, and/or knocking over the glass among other examples. Such messes can be time consuming and tiring for parents or other caretakers to clean. Additionally, the risk for such messes can be stressful for parents and caretakers.

Thus, there is a need for improvement in this field.

SUMMARY

Toddlers and young children generally learn new skills through practice and active participation. One such skill is pouring a liquid into a cup. Toddlers typically do not have the dexterity and precision needed to pour liquids into a traditional cup without spilling and/or making a mess. In many cases, such spills may create more work and may increase stress on parents and/or caretakers who have to clean up. A unique cup holding unit allows toddlers to practice pouring liquids while containing the spills and/or messes. The cup holding unit is configured to receive a cup and catch spills from pours that miss the cup.

Generally, the cup holding unit includes a body and a basket. The body defines a cavity that is shaped to receive the basket. In one version, the body is shaped with a circular cross-section, such as in a generally cylindrical shape. In another version, the body is shaped with an oval cross-section. The basket generally catches liquids that miss the cup during pouring. In one example, the basket is removable from the body. By allowing the basket to be removed, the cup holding unit facilitates disposing of spilled liquids and emptying the basket. Further, the basket defines multiple perforations in one version. The perforations allow liquid to drain from the basket into the cavity of the body. Using perforations allows the basket to provide a buffer for the spilled liquid and limit splashing.

The cup holding unit further includes a cup holder that secures the cup in place. The basket extends around the cup holder. The cup holder is shaped to hold a traditional cup within the basket. To secure the cup in place, the cup holder includes pads made of a deformable and non-stick material. The pads conform to the shape of the cup. Using non-stick material resists movement from the cup when inserted into the cup holder. In one example, the cup holder is removable from the body. In another example, the cup holder is integrated with the body as a single part. Further, in one example, the cup holder defines holes that allow spilled liquid to drain from the cup holder to the basket. The holes facilitate directing all the spilled liquid into the basket for efficient disposal and cleaning. In one version, the cup holding unit includes pegs that are positioned around the cup holder. The pegs are positioned in the cavity of the body and/or in the basket. The pegs break up the flow of spilled liquid to limit or prevent splashing.

The cup holding unit further includes a spout. The spout allows liquid to drain from the body and/or the basket. In one example, the spout is configured to rotate out from the body. When rotated outward, the spout allows liquids to drain from the basket and/or the cavity of the body. Using the spout allows parents and/or caretakers to dispose of spilled liquids in a quick and simple way. In one example, the spout is held in a closed position when the spout is pushed upward. The body in one version biases the spout upward using a spring-loaded mechanism. Further, the spout includes a valve that closes when the spout is pushed up. The valve and spring-biasing ensures that the spout remains closed and retains all the liquids unless the user manually opens the spout.

In one example, the cup holding unit includes a suction cup on a bottom portion. The suction cup secures the body in place against a table or other surface during pouring. The number of suction cups can vary. In one example, the cup holding unit includes one suction cup positioned centrally on the body. In another example, the cup holding unit includes multiple suction cups positioned both centrally and around a perimeter of the body. For instance, in one arrangement, the cup holding unit includes six suction cups positioned centrally, such as in two rows of three suction cups. In another arrangement, the suction cups are arranged in a hexagonal pattern.

In one version, the cup holding unit includes a suction lever that applies the suction cup when pressed. For instance, one version of the suction lever engages one suction cup on the center of the body. The suction lever facilitates engaging the suction cup on a surface before pouring. The suction lever operates a suction cup mechanism that includes an applicator plate and a housing. The housing contains the mechanism within the interior of the body. The applicator plate rotates about a hinge when the lever is pushed and presses on the suction cup to engage the suction cup against a table or another surface. In another version, the cup holding unit includes the suction cup and not the suction lever. For instance, one version of the cup holding unit can apply multiple suction cups without the suction lever. Further, the cup holding unit typically includes a release tab that releases the suction cup when lifted. The release tab facilitates disengaging the suction cup from a surface after pouring is finished.

The cup holding unit further includes a base supporting the body on the suction cups. The base is toollessly attachable and detachable to the body. In one example, the body includes a tab that slides into a slot on the base when the body is rotated. The tab and slot secure the body against the base. In another example, the body includes a knob that slides into a channel on the base. The knob secures the body against the base.

The systems and techniques as described and illustrated herein concern a number of unique and inventive aspects. Some, but by no means all, of these unique aspects are summarized below.

Aspect 1 generally concerns a system.

Aspect 2 generally concerns the system of any previous aspect including a cup holding unit.

Aspect 3 generally concerns the system of any previous aspect in which the cup holding unit includes a body defining a cavity.

Aspect 4 generally concerns the system of any previous aspect including a cup holding unit configured to receive a cup.

Aspect 5 generally concerns the system of any previous aspect in which the cup holding unit includes a suction cup on a bottom portion.

Aspect 6 generally concerns the system of any previous aspect in which the cup holding unit includes a release tab configured to release the suction cup.

Aspect 7 generally concerns the system of any previous aspect in which the cup holding unit includes a suction lever configured to engage the suction cup.

Aspect 8 generally concerns the system of any previous aspect in which the cup holding unit includes multiple suction cups arranged around an outer perimeter.

Aspect 9 generally concerns the system of any previous aspect in which the cup holding unit includes multiple rows of suction cups arranged near the center.

Aspect 10 generally concerns the system of any previous aspect in which the suction cups are arranged in two rows of three.

Aspect 11 generally concerns the system of any previous aspect in which the cup holding unit catches liquids that spill while being poured into the cup.

Aspect 12 generally concerns the system of any previous aspect in which the cup holding unit includes a basket configured to catch spilled liquid.

Aspect 13 generally concerns the system of any previous aspect in which the basket has one or more pegs extending from the basket to break up flow for reducing splashing.

Aspect 14 generally concerns the system of any previous aspect in which the cup holding unit includes a cup holder positioned within the basket.

Aspect 15 generally concerns the system of any previous aspect in which the cup holder defines multiple holes that allow liquid to drain into the basket.

Aspect 16 generally concerns the system of any previous aspect in which the cup holding unit includes a spout that allows liquid to drain from the basket.

Aspect 17 generally concerns the system of any previous aspect in which the spout rotates out from the body.

Aspect 18 generally concerns the system of any previous aspect in which the basket is removable from the cavity on the body.

Aspect 19 generally concerns the system of any previous aspect including a cup holder.

Aspect 20 generally concerns the system of any previous aspect in which the cup holder is configured to receive a cup.

Aspect 21 generally concerns the system of any previous aspect including a body defining a cavity.

Aspect 22 generally concerns the system of any previous aspect including a cup holder positioned on the body.

Aspect 23 generally concerns the system of any previous aspect including a basket positioned in the cavity on the body.

Aspect 24 generally concerns the system of any previous aspect in which the basket extends around the cup holder.

Aspect 25 generally concerns the system of any previous aspect in which the basket is configured to catch liquid that spills when pouring into the cup.

Aspect 26 generally concerns the system of any previous aspect including a suction cup positioned under the body.

Aspect 27 generally concerns the system of any previous aspect in which the suction cup is configured to secure the body in place against a surface during pouring.

Aspect 28 generally concerns the system of any previous aspect including a suction lever.

Aspect 29 generally concerns the system of any previous aspect in which the suction lever engages the suction cup against the surface when pressed.

Aspect 30 generally concerns the system of any previous aspect including a base attached on a bottom side of the body.

Aspect 31 generally concerns the system of any previous aspect in which the base is toollessly attachable and detachable from the body.

Aspect 32 generally concerns the system of any previous aspect in which the base defines slots.

Aspect 33 generally concerns the system of any previous aspect in which the body includes tabs.

Aspect 34 generally concerns the system of any previous aspect in which the tabs are positioned on opposite sides of the center of the body.

Aspect 35 generally concerns the system of any previous aspect in which the tabs slide into the slots when the body is rotated relative to the base.

Aspect 36 generally concerns the system of any previous aspect in which the body is secured against the base when the tabs are positioned in the slots.

Aspect 37 generally concerns the system of any previous aspect in which the basket defines multiple perforations.

Aspect 38 generally concerns the system of any previous aspect in which the perforations allow liquid to drain from the basket into the cavity on the body.

Aspect 39 generally concerns the system of any previous aspect in which the body includes multiple pegs extending into the cavity.

Aspect 40 generally concerns the system of any previous aspect in which the pegs are configured to disrupt the flow of liquid such as to inhibit the liquid from splashing.

Aspect 41 generally concerns the system of any previous aspect in which the suction cup is mounted to the base.

Aspect 42 generally concerns the system of any previous aspect including a release tab.

Aspect 43 generally concerns the system of any previous aspect in which the release tab disengages the suction cup from the surface when pulled.

Aspect 44 generally concerns the system of any previous aspect in which the cup holding unit includes multiple suctions cups.

Aspect 45 generally concerns the system of any previous aspect in which the base is mounted to multiple suction cups.

Aspect 46 generally concerns the system of any previous aspect in which the suction cups are arranged along a perimeter of the base.

Aspect 47 generally concerns the system of any previous aspect in which the suction cups are arranged near the center of the base.

Aspect 48 generally concerns the system of any previous aspect in which the suction cups near the center are arranged in a hexagon pattern.

Aspect 49 generally concerns the system of any previous aspect in which the suction cups near the center are arranged in a rectangular grid pattern.

Aspect 50 generally concerns the system of any previous aspect including a spout positioned on the body.

Aspect 51 generally concerns the system of any previous aspect in which the spout is rotatable from the body.

Aspect 52 generally concerns the system of any previous aspect in which the spout allows liquid to flow when rotated away from the body.

Aspect 53 generally concerns the system of any previous aspect in which the spout prevents liquid from flowing when rotated into the body.

Aspect 54 generally concerns the system of any previous aspect in which the spout includes a lift valve.

Aspect 55 generally concerns the system of any previous aspect in which the body defines a spout cavity.

Aspect 56 generally concerns the system of any previous aspect in which the spout is positioned in the spout cavity on the body.

Aspect 57 generally concerns the system of any previous aspect in which the spout cavity provides space for the spout to move in a vertical direction between top side and a bottom side.

Aspect 58 generally concerns the system of any previous aspect in which the spout is locked from rotating away from the body when the spout is positioned toward the top side of the body within the spout cavity.

Aspect 59 generally concerns the system of any previous aspect in which the spout is spring-biased toward the top side of the body.

Aspect 60 generally concerns the system of any previous aspect in which the lift valve prevents liquid from flowing through the spout when the spout is positioned toward the top side of the body within the cavity.

Aspect 61 generally concerns the system of any previous aspect in which the cup holder is toollessly detachable from the body.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
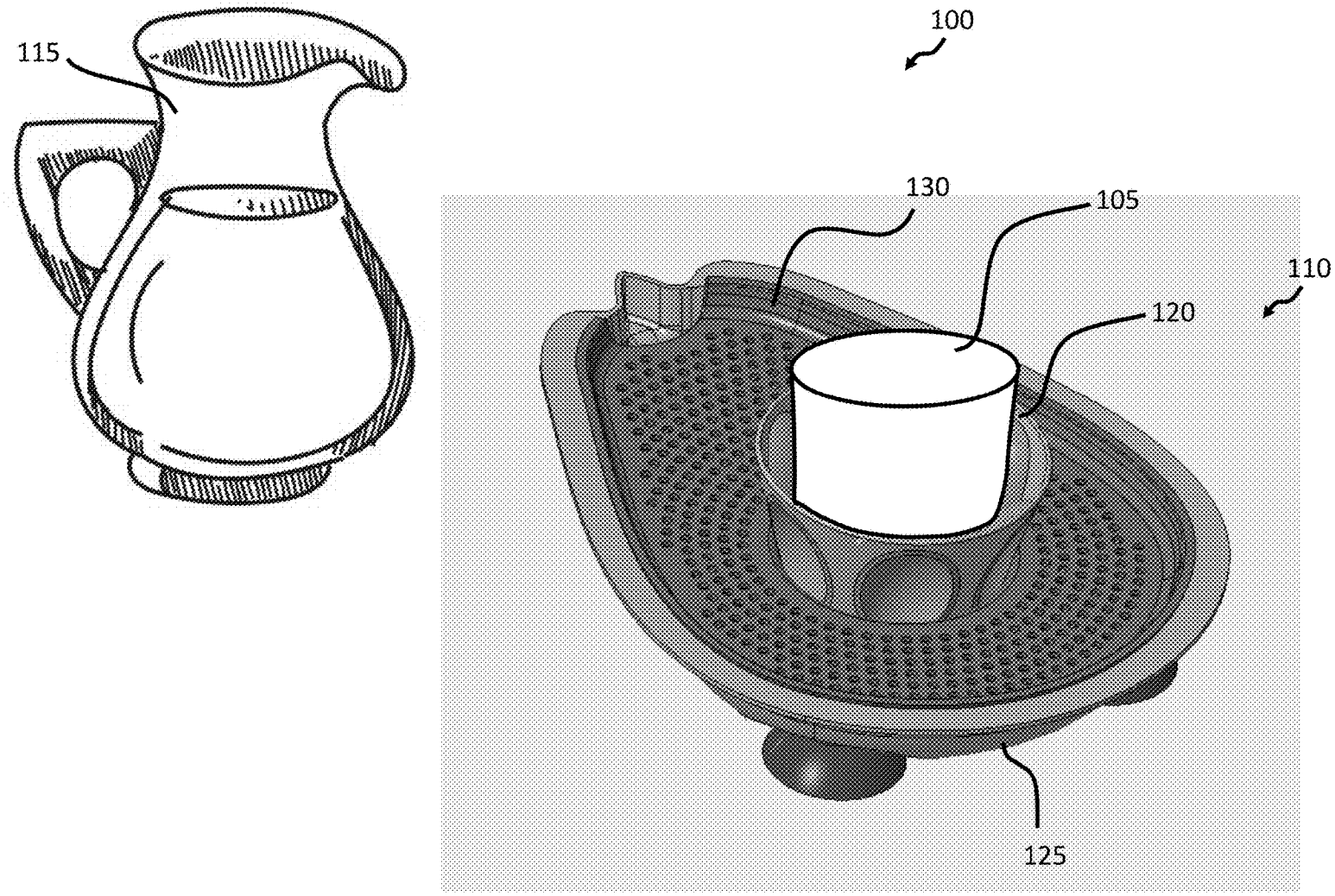
FIG. 1 is a perspective view of a system according to one example.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

Referring to FIG. 1, a system 100 is used for preventing messes and/or spills when pouring liquids. The system 100 generally includes a cup 105, a cup holding unit 110, and a pitcher 115. Users can pour water or other liquids from the pitcher 115 into the cup 105. The cup holding unit 110 is configured to receive the cup 105 and to hold the cup 105 in place. Typically, the cup holding unit 110 is positioned on a table, a countertop, a floor, or another surface. As liquid is poured from the pitcher 115, the cup holding unit 110 catches any liquid that misses the cup 105 and/or splashes out of the cup 105. By catching the spilled liquid, the cup holding unit 110 contains spills and prevents spills and messes from reaching the table and/or other surfaces. Toddlers, older adults, and/or people with conditions that affect motor skills can lack the dexterity and/or precision to pour into the cup 105 without missing and/or spilling. The resulting spills and messes can require much time and effort to clean and can cause stress to parents and caretakers. Users can utilize the cup holding unit 110 to avoid creating a mess when pouring liquids into the cup 105. In one example, the cup holding unit 110 can be used to teach toddlers to pour liquids while containing any spilled liquid. For instance, the cup holding unit 110 allows toddlers to practice pouring liquids and to develop motor skills without creating a mess outside the cup holding unit 110. Additionally, the cup holding unit 110 can be used by adults with weakened motor skills to facilitate pouring beverages into the cup 105 without creating a mess. The cup holding unit 110 can save the time and effort of cleaning for users, parents, and/or caretakers by preventing the mess in the first place. Further, the cup holding unit 110 can eliminate the stress on users, caretakers, and parents of having to deal with potential messes and/or spills.

The cup holding unit 110 generally includes a cup holder 120, a body 125, and a basket 130. The cup holder 120 is configured to receive the cup 105 and to secure the cup 105 in place. The cup holder 120 is positioned toward a top side 112 of the cup holding unit 110. The cup holder 120 is generally cylindrical in shape, such as to resemble a typical shape of the cup 105. The cup holder 120 is configured to receive various sizes of the cup 105, such as cups 105 having a diameter within a set range. At least part of the cup holder 120 is made of a rigid material, such as plastic for example. In one version, the cup holder 120 can be integrally formed with the body 125. In another version, the cup holder 120 is a distinct part that is removable from the cup holding unit 110. Removing the cup holder 120 from the cup holding unit 110 can facilitate cleaning the cup holder 120.

The body 125 generally provides the structure of the cup holding unit 110. The body 125 is positioned toward a bottom side 114 of the cup holding unit 110. The body 125 is made of a rigid material, such as plastic. In the FIG. 1 version, a cross-sectional shape of the body 125 is generally an oval. In another version, the body 125 has a generally circular cross-sectional shape. The basket 130 is positioned at least partially within the body 125. The basket 130 has a similar cross-sectional shape as the body 125. The similar shapes allow the basket 130 to fit snugly within the body 125 and to remain in place during pouring. The body 125 and the basket 130 extend around the cup 105 to contain spills. To catch spills and prevent messes, the body 125 and/or the basket 130 define space to receive and contain spilled liquids during pouring. In one version, the body 125 defines a space to receive the spilled liquid and the basket 130 provides a buffer to limit splashing. In another version, the basket 130 is configured to contain the spilled liquid. Further, in one example, the basket 130 is removable from the body 125 to facilitate emptying the liquid and/or cleaning the basket 130.

Figure 2:
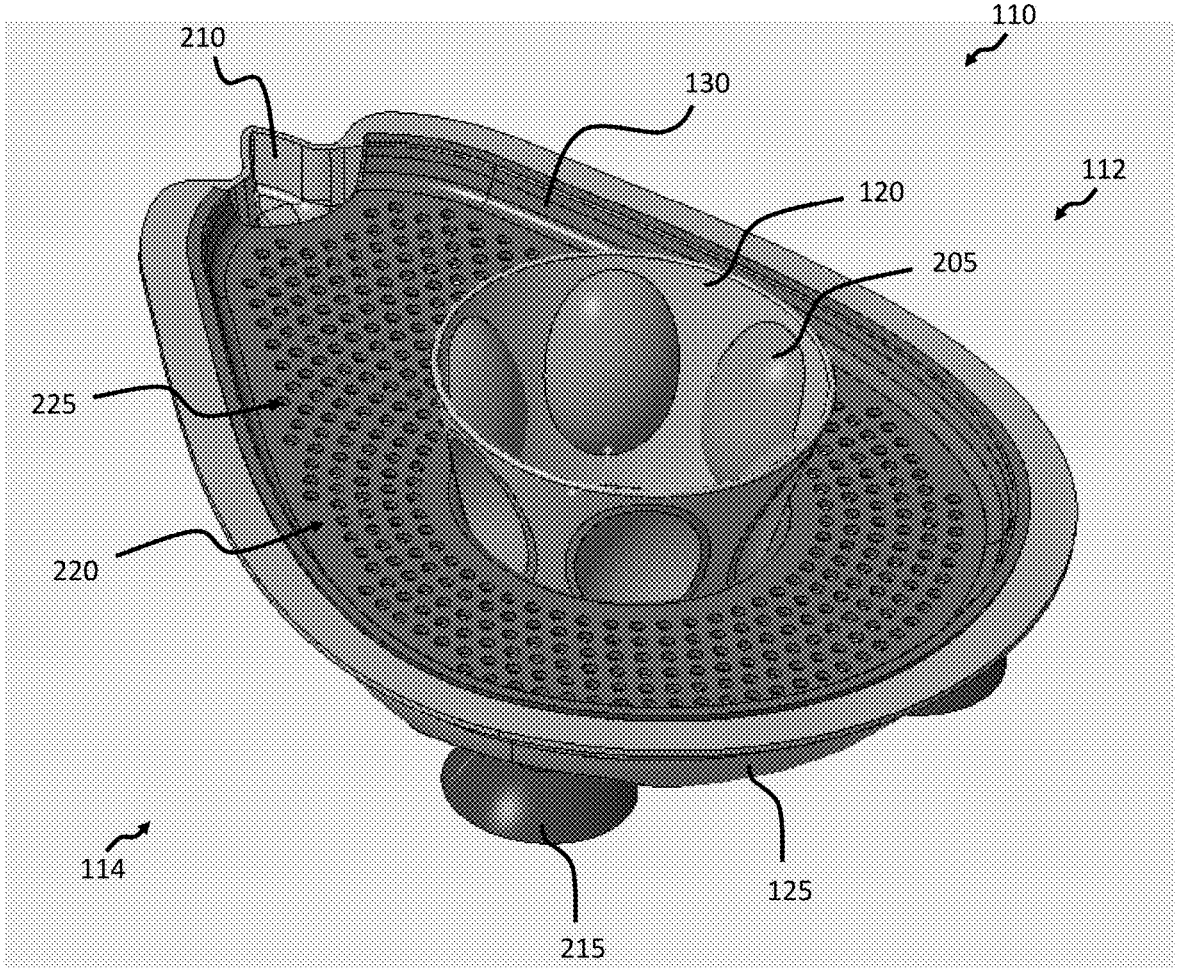
FIG. 2 is a perspective view of a cup holding unit from the FIG. 1 system.

FIG. 2 illustrates the cup holding unit 110 isolated from the cup 105 and the pitcher 115. As shown, the cup holder 120 includes one or more pads 205. In the illustrated example, the cup holder 120 includes six pads 205 spaced evenly around a circumference of the cup holder 120. The pads 205 are made of a deformable material, such as a rubber, plastic, and/or silicone. Typically, the pads 205 are hollow and dome-shaped. The pads 205 generally extend toward the interior of the cup holder 120, and the hollow spaces of the pads 205 open toward the exterior of the cup holder 120. In an alternative version, the pads 205 are solid domes that are positioned in the interior of the cup holder 120. In the illustrated example, the pads 205 are generally egg-shaped. To hold the cup 105 in place in the cup holder 120, the pads 205 are configured to deform to accommodate the cup 105. The pads 205 typically contact the cup 105 when the cup 105 is positioned in the cup holder 120. The pads 205 are made of and/or are coated with a non-slip material. The non-slip material inhibits or fully prevents the cup 105 from rotating and/or moving laterally within the cup holder 120. Using the pads 205, the cup holder 120 is configured to maintain a consistent position and orientation of the cup 105 during pouring.

The cup holding unit 110 further includes a spout 210. The spout 210 facilitates emptying the spilled liquid from the cup holding unit 110. For example, the spout 210 allows a user to tilt the cup holding unit 110 to direct the liquid toward the spout 210 and then pour the liquid in a controlled manner. In the illustrated example, the spout 210 is formed as a part of the body 125 and allows liquid contained in the body 125 to be removed. In another example, the spout 210 is part of the basket 130 and supports emptying liquid that is contained in the basket 130. In the FIG. 2 example, the spout 210 is fixed. In an alternative example, the spout 210 is configured to fold out from the body 125.

To secure the cup holding unit 110 in place, the cup holding unit 110 includes one or more suction cups 215. The suction cups 215 are configured to attach to a flat surface, such as a tabletop, a countertop, a floor, and/or another surface. By attaching to such surfaces, the suction cups 215 maintain the position of the cup holding unit 110 during pouring. This reduces the risk that liquids are poured outside of the cup holding unit 110 and make a mess. Further, the suction cups 215 generally maintain the orientation of the cup holding unit 110. This generally prevents a user from knocking over the cup holding unit 110 and spilling the liquid contained in the cup 105 and/or the body 125. For example, the suction cups 215 resist or fully prevent the cup holding unit 110 from being knocked over by a toddler accidentally pushing the cup holding unit 110, by uncontrollable or unintentional hand movements, and/or other user actions. The cup holding unit 110 can include any number, size, and/or arrangement of the suction cups 215. In one example, the cup holding unit 110 includes one relatively large suction cup 215 positioned in the center of the bottom side 114 of the cup holding unit 110. In another example, the cup holding unit 110 includes multiple smaller suction cups 215 positioned in a pattern on the bottom side 114, such as in a hexagonal pattern or in a two-by-three grid.

As shown in FIG. 2, the basket 130 generally defines a spill area 220. Liquids that spill during pouring initially enter the spill area 220. In the illustrated example, the basket 130 further defines multiple perforations 225. The perforations 225 allows liquid to drain from the spill area 220 into the body 125. The basket 130 can utilize any number, size, and/or arrangement of the perforations 225. In the FIG. 2 example, the perforations 225 are each cylindrical with the same diameter. In that example, the perforations 225 are arranged concentrically around the cup holder 120 and are positioned across a majority of the surface of the basket 130. Using the perforations 225 allows the basket 130 to act as a buffer for spilled liquid. For example, the basket 130 allows the liquid to drain into the body 125 in a controlled way with limited splashing. Further, the basket 130 inhibits or fully blocks liquid stored in the body 125 from splashing out of the cup holding unit 110, such as when a user moves the cup holding unit 110 to be emptied. The perforations 225 on the basket 130 therefore help the cup holding unit 110 to contain more of the spilled liquid and minimize the risk of potential messes.

Figure 3:
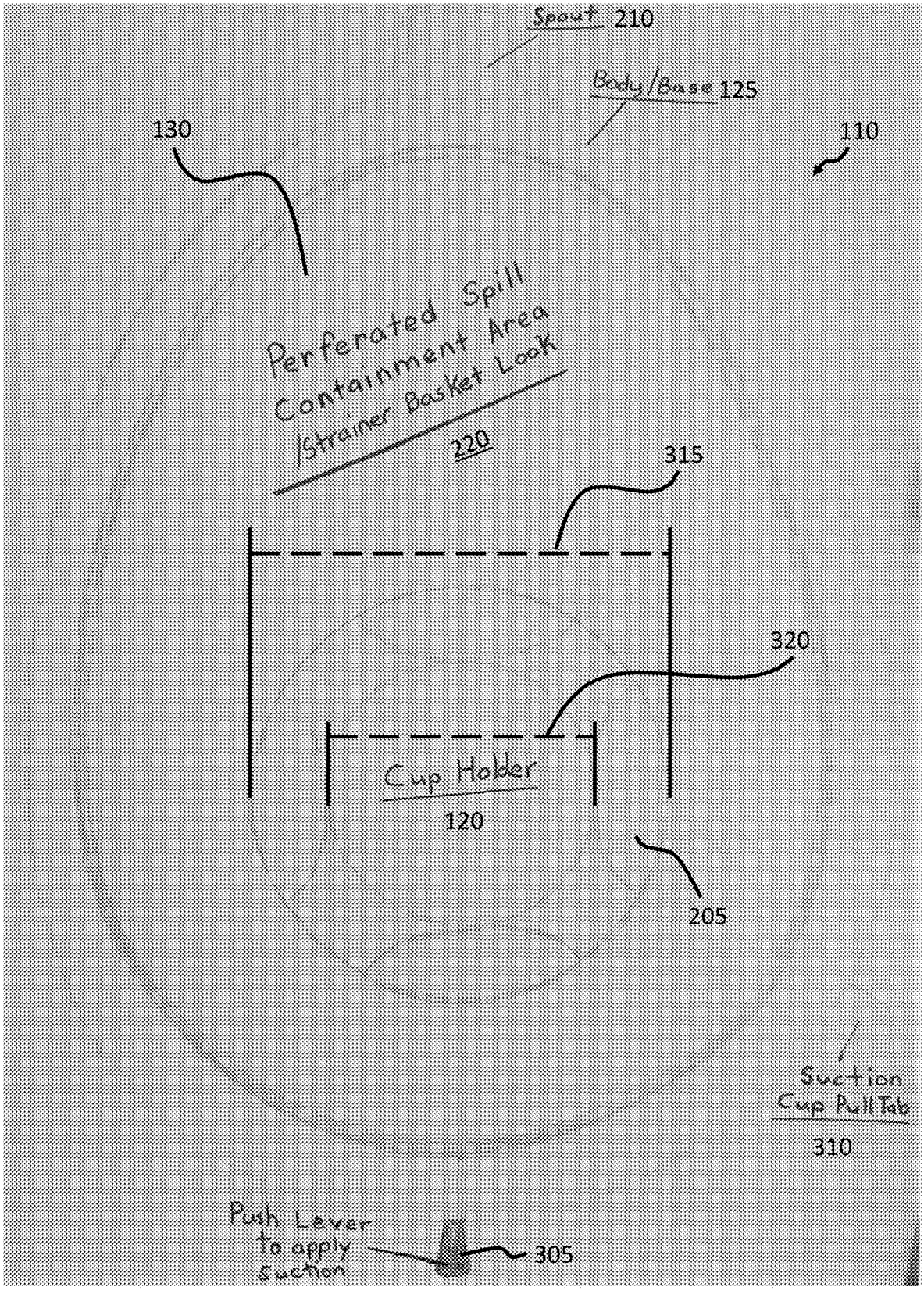
FIG. 3 is a top view of the FIG. 2 cup holding unit according to one example.

Referring to FIG. 3, the cup holding unit 110 further includes a suction lever 305 and a release tab 310 in one example. The suction lever 305 and the release tab 310 facilitate attaching or detaching the cup holding unit 110 to a surface via the suction cup 215. Pushing the suction lever 305 allows a user to manually engage the suction cup 215 to a table or other surface. For instance, a user can place the cup holding unit 110 on the table at a desired location and then push the suction lever 305 to secure the cup holding unit 110 in place on the table. Pushing on the entire cup holding unit 110 to engage the suction cup 215 can create a risk of shaking or tipping the cup holding unit 110. Instead, pressing the suction lever 305 applies directed force to reliably engage the suction cup 215 while the rest of the cup holding unit 110 remains stationary. Conversely, the release tab 310 allows a user to disengage the suction cup 215 from a surface. Pulling the release tab 310 lifts the suction cup 215 partially to break the vacuum seal and eliminate the suction. Again, trying to apply force to the entire cup holding unit 110 can result in shaking or tipping the cup holding unit 110 and therefore spilling. Pulling on just the release tab 310 reduces the risk of shaking or tipping the cup holding unit 110 by allowing the cup holding unit 110 to remain stationary. The suction lever 305 and the release tab 310 allow the suction cup 215 to attach and detach from surfaces in a controlled and reliable way. Attaching and detaching the suction cup 215 in this way further supports the cup holding unit 110 to contain spilled liquid and prevent messes.

As shown, the cup holder 120 defines a first diameter 315 and a second diameter 320. The first diameter 315 is a maximum inner diameter of the cup holder 120. The cup holder 120 defines the first diameter 315 on the top side 112 of the cup holder 120. The first diameter 315 corresponds to the largest size cup 105 that the cup holder 120 can receive. The second diameter 320 is a minimum inner diameter of the cup holder 120. The cup holder 120 defines the second diameter 320 toward the bottom side 114 on the cup holder 120. In one example, the pads 205 are spaced across from each other by the second diameter 320. In that example, the second diameter 320 corresponds to the smallest size cup 105 that the cup holder 120 fixes in place laterally within the cup holder 120. The pads 205 are configured to flex to allow the cup holder 120 to receive a cup 105 that has a diameter between the first diameter 315 and the second diameter 320. The cup holder 120 limits movement of smaller cups 105 that are placed in the cup holder 120 but does not necessarily fix the position of such cups 105.

Figure 4:
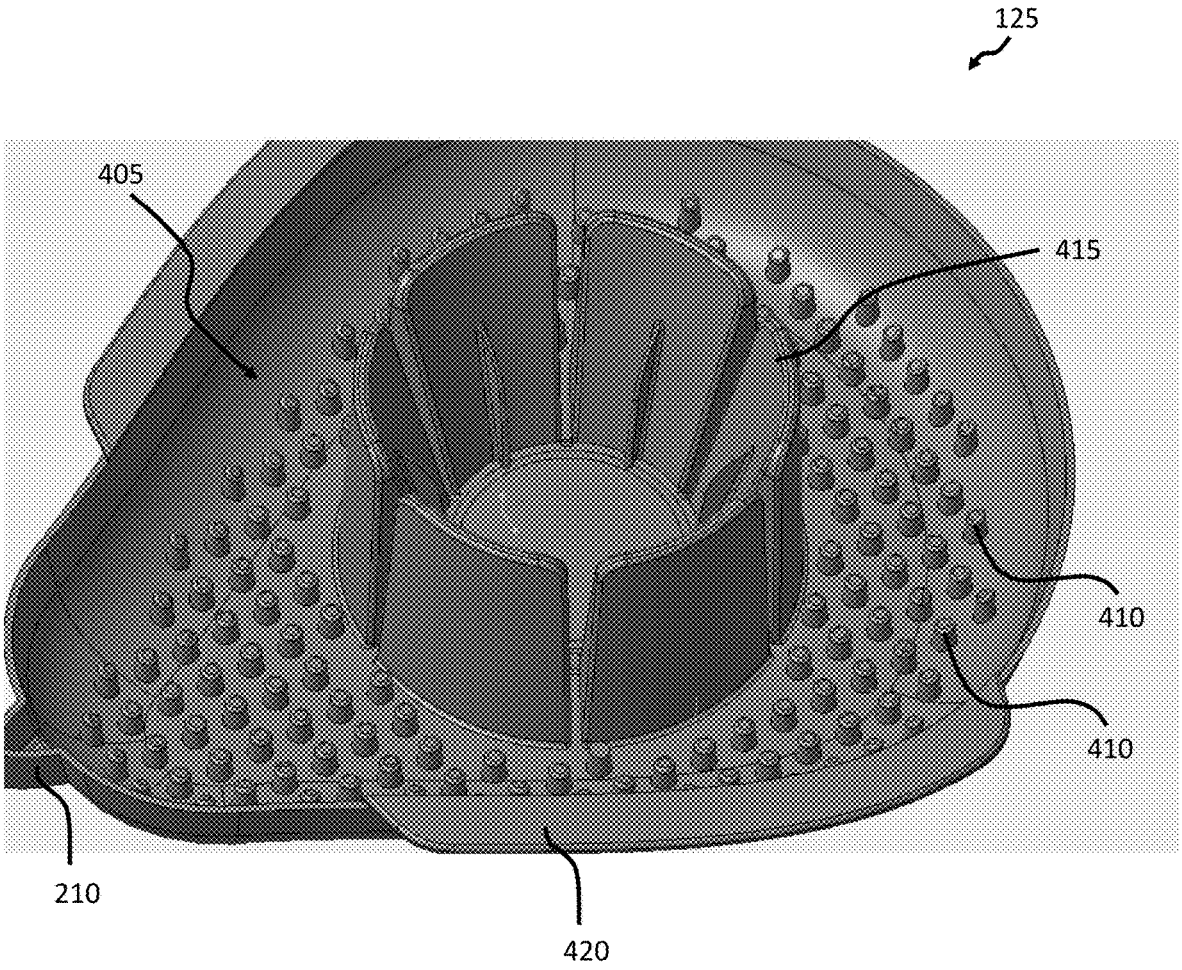
FIG. 4 is a perspective view of a body from the FIG. 2 cup holding unit.

FIG. 4 illustrates the body 125 according to one example. As shown, the body 125 defines a cavity 405. Further, the body 125 generally includes multiple pegs 410, a cup support 415, and a flange 420 in the illustrated example. The body 125 is generally formed as a single part. For example, the body 125 is formed by injection molding, thermoforming, and/or vacuum molding a plastic part. In an alternative example, one or more parts of the body 125 are formed separately.

The cavity 405 generally provides a space for containing liquids within the body 125. When the basket 130 is attached to the body 125, the basket 130 sits at least partially within the cavity 405. The basket 130 stays in place in the body 125 via gravity and/or through a friction fit and/or a snap fit connection. In one example, the cavity 405 and the spout 210 form a continuous opening on the top side 112 of the body 125. In another example, the cavity 405 and the spout 210 form separate openings on the top side 112 of the body 125. For instance, such as in the FIG. 3 example, the body 125 includes a strip that separates upper openings of the spout 210 and of the cavity 405. The pegs 410 are positioned on an inner surface of the body 125 and extend into the cavity 405. The pegs 410 disrupt liquid that enters into the cavity 405. Disrupting the flow of liquid generally reduces splashing and facilitates containing the liquid. In one version, the pegs 410 on the body 125 are positioned in a similar way as the perforations 225 on the basket 130, shown in FIG. 2. In one example, the pegs 410 are positioned concentrically around the cup holder 120 in the cup holding unit 110. In another example, the pegs 410 are generally cylindrical and have similar or the same diameters. In a further example, upper surfaces on the pegs 410 generally match the contour of the inner surface of the body 125.

The cup support 415 is configured to provide structural support to the cup holder 120 when attaching to the body 125. In one example, the cup support 415 is made of multiple segments that are separated, such as six evenly spaced segments. In one version, the cup support 415 inserts into the cup holder 120 to provide structural support. In another version, the cup holder 120 is formed as a part of the body 125 and the cup support 415 forms the cup holder 120. In that version, the pads 205 are optionally attached to each segment of the cup support 415.

The flange 420 provides a place for users to lift and/or grab the body 125. For example, the flange 420 allows the user to lift the body 125 when going to empty liquid from the cavity 405. As another example, the flange 420 allows the user to hold the body 125 down when removing the basket 130, such as for cleaning the basket 130 and/or for emptying liquid. In the illustrated example, the body 125 has one flange 420 on each lateral side of the body 125. In an alternative example, the body 125 has one flange 420 that extends around both sides of the body 125.

Figure 5:
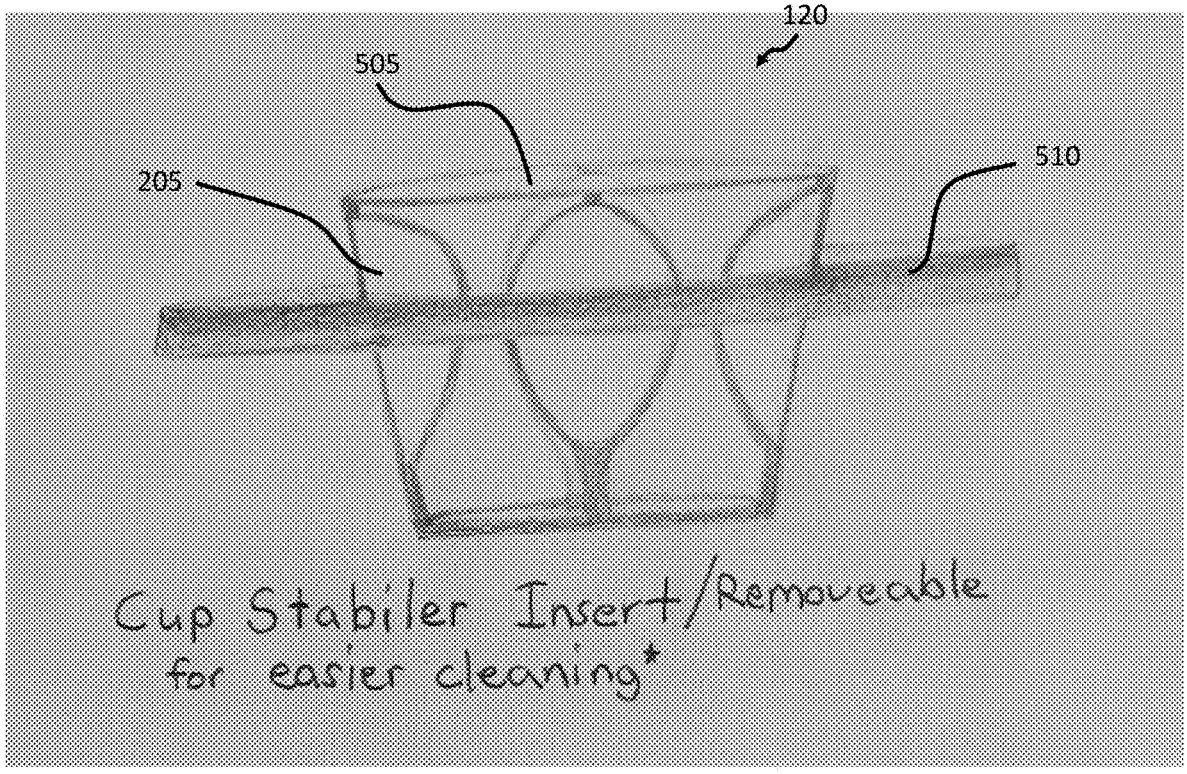
FIG. 5 is a perspective view of a cup holder from the FIG. 2 cup holding unit.

Referring to FIG. 5, the cup holder 120 is removable from the cup holding unit 110 in one example. Using a removable cup holder 120 allows the cup holder 120 to be cleaned easily. In the FIG. 5 example, the cup holder 120 includes a shell 505 and a stabilizer 510. The shell 505 provides the main structure of the cup holder 120. The pads 205 are positioned on the shell 505 to help secure the cup 105 within the shell 505. In one example, the shell 505 defines multiple openings and/or perforations to allow liquid to drain from the cup holder 120 into the body 125 and/or the basket 130. The stabilizer 510 generally extends around the shell 505. The stabilizer 510 helps to maintain the orientation of the cup holder 120 when the cup holding unit 110 is fully assembled. In one example, the shell 505 and stabilizer 510 are formed as a single part, such as through injection molding, thermoforming, and/or vacuum molding. In an alternative example, the shell 505 and the stabilizer 510 are formed separately and attached or fused together.

When attaching the cup holder 120 to the rest of the cup holding unit 110, the shell 505 typically attaches to the cup support 415 on the body 125, shown in FIG. 4. The shell 505 attaches through a friction fit, snap-fit, and/or another type of connection with the cup support 415. In one version, the shell 505 is positioned fully in the center of the cup support 415. In another example, the shell 505 extends partially around the cup support 415 to allow a portion of the cup support 415 to slide into and nest within the shell 505. For instance, the shell 505 defines a cavity and/or a slot for each segment of the cup support 415. Alternatively or additionally, other parts, such as the basket 130, hold the cup holder 120 in place on the body 125 when attached.

The stabilizer 510 maintains the orientation of the cup holder 120 relative to the rest of the cup holding unit 110. When the cup holding unit 110 is fully assembled, the stabilizer 510 rests on the top side 112 on the cup support 415. Further, the basket 130 rests on the top side 112 on the stabilizer 510. The basket 130 and the cup support 415 therefore sandwich the stabilizer 510 to prevent the stabilizer 510 from tilting and/or lifting out of place. The relatively thin disc shape of the stabilizer 510 allows the stabilizer 510 to sit inconspicuously between different parts of the cup holding unit 110. In one version, the stabilizer 510 further provides support for the basket 130. The basket 130 optionally attaches to the shell 505 and/or the stabilizer 510, such as through a friction fit and/or snap-fit connection. In an alternative version, the cup holder 120 and the basket 130 are formed as a single part and/or are fused together. For instance, the stabilizer 510 forms the basket 130.

Figure 6:
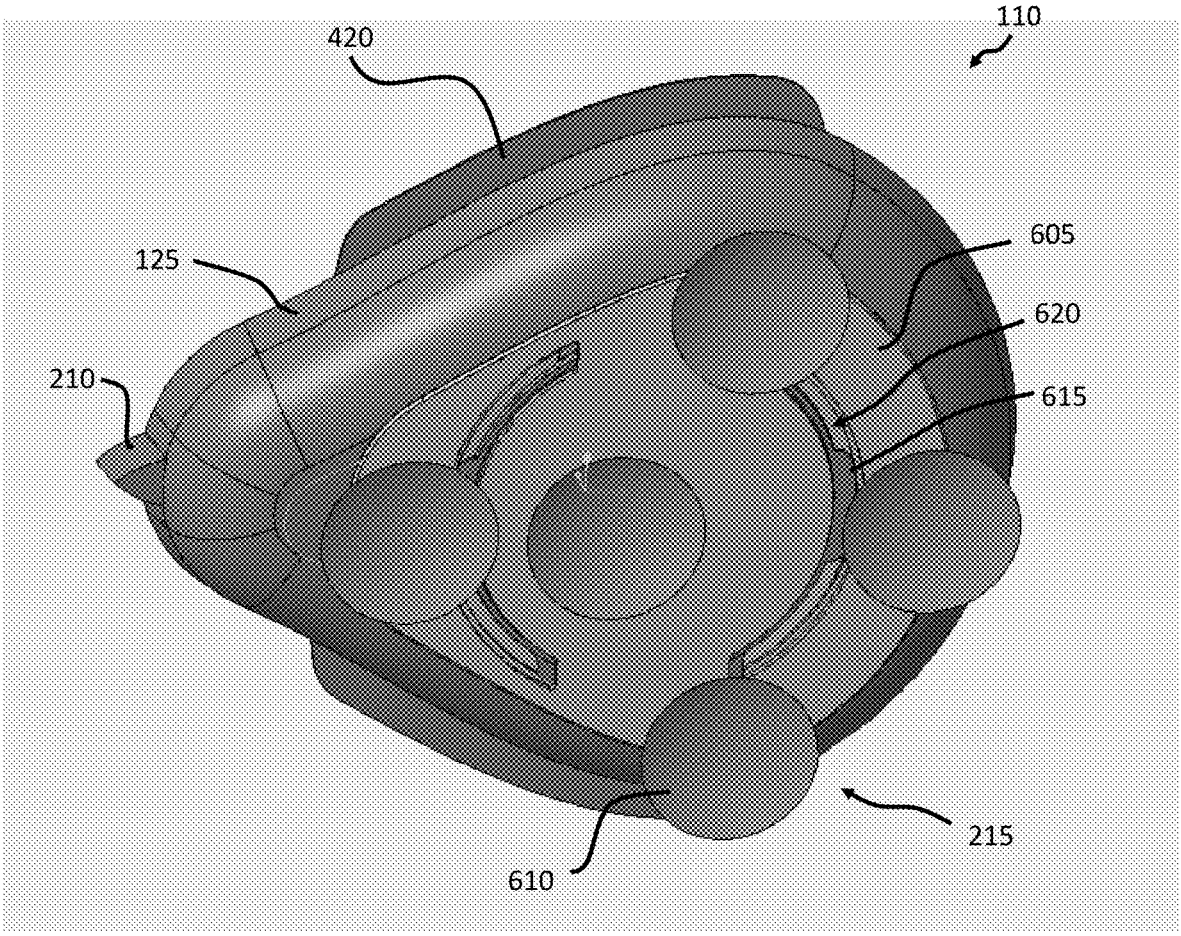
FIG. 6 is a bottom perspective view of the FIG. 2 system including a base according to one example.
Figure 7:
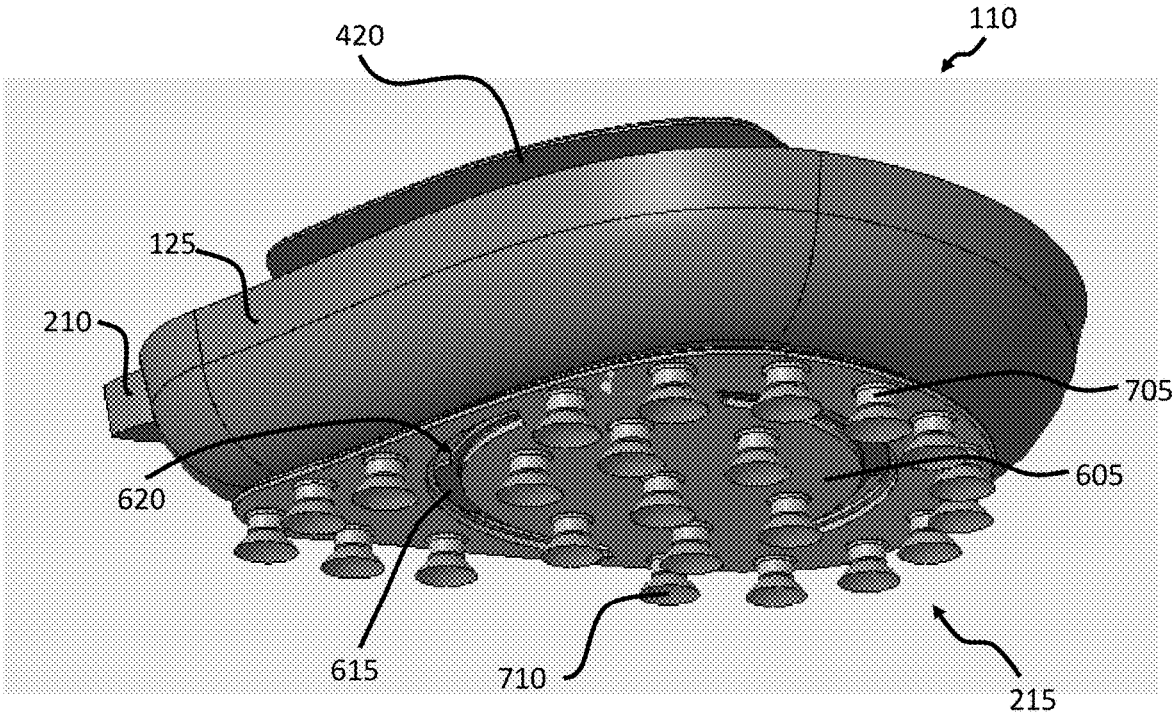
FIG. 7 is a bottom perspective view of the FIG. 2 system including a base according to another example.

Referring to FIGS. 6 and 7, the cup holding unit 110 includes a base 605 attached on the bottom side 114 of the body 125. The base 605 generally provides a structural foundation for body 125 on top of the suction cups 215. In the illustrated example, the base 605 is detachable from the body 125. This allows the body 125 to be quickly and easily separated from the suction cups 215 and the table surface, such as for emptying the liquid from the body 125. In an alternate example, the base 605 is integrally formed and/or permanently fixed to the body 125. As shown in FIG. 7, the base 605 includes an attachment stem 705 for each suction cup 215. The attachment stems 705 attach each suction cup 215 to the base 605. The suction cups 215 fix to the attachment stem 705 through a friction fit, a snap-fit connection, adhesive, and/or in another way. The attachment stems 705 disperse the weight of the cup holding unit 110 through the base 605 to the suction cups 215.

The base 605 toolessly attaches to the body 125 through interlocking parts. As shown, the body 125 includes one or more tabs 615. The base 605 defines a slot 620 for each tab 615. When the tabs 615 are positioned in the slots 620, the tabs 615 secure the base 605 against the body 125. Using two tabs 615 on opposite sides additionally prevents lateral movement of the base 605 relative to the body 125. The base 605 is generally attached and detached through a rotational twisting motion relative to the body 125. When the base 605 is oriented such that the tabs 615 are positioned outside the ends of the slots 620, the base 605 is free to move relative to the body 125. A user can rotate the base 605 to cause the tabs 615 to slide into the slots 620. This attaches the base 605 to the body 125. The user can then continue rotating and/or rotate the base 605 in the opposite direction to the slide the tabs 615 out of the slots 620. This detaches the base 605 from the body 125. Using this rotation movement allows the base 605 and the body 125 to be attached and detached without tilting and/or shaking the cup holding unit 110. Attaching/detaching the base 605 and the body 125 in this way therefore reduces the risk of unintentionally spilling liquid from the cup holding unit 110.

As noted, the cup holding unit 110 can include the suction cups 215 in a variety of sizes and arrangements. In the FIG. 6 example, the suction cups 215 are in the form of large suction cups 610. The large suction cups 610 are generally arranged with one large suction cup 610 positioned near the center of the base 605 and the remaining large suction cups 610 positioned around a perimeter of the base 605. In the FIG. 6 illustration, the cup holding unit 110 includes five large suction cups 610. In another version, the cup holding unit 110 includes just one large suction cup 610 that is positioned in the center of the base 605. Conversely, in the FIG. 7 example, the suction cups 215 are in the form of small suction cups 710. The small suction cups 710 have smaller diameters compared to the large suction cups 610. The small suction cups 710 are generally arranged in a pattern near the center of the base 605. In the FIG. 7 illustration, the cup holding unit 110 includes seven small suction cups 710 arranged in a hexagonal pattern near the center of the base 605. In another example, the small suction cups 710 are arranged in a two-by-three grid near the center of the base 605. As illustrated, the small suction cups 710 additionally are positioned along a perimeter of the base 605. In yet another version, the base 605 includes a combination of one or more large suction cups 610 and small suction cups 710. For instance, the base 605 optionally includes one large suction cup 610 positioned centrally and multiple small suction cups 710 positioned along the perimeter.

As should be appreciated, the suction lever 305 and the release tab 310, shown in FIG. 3, can be utilized in a variety of arrangements of the suction cups 215. In one example, the suction lever 305 is configured to engage all of the large suction cups 610 and/or the small suction cups 710 on the base 605. For instance, the suction lever 305 is positioned on the base 605. In such an example, the base 605 further includes the release tab 310. The base 605 includes one release tab 310 for each suction cup 215 and/or one release tab 310 that disengages all the suction cups 215 on the base 605. In another example, the suction cups 215 are positioned on the body 125. In that example, the suction lever 305 is positioned on the body 125. The mechanism of the suction lever 305 further is positioned within or beneath the body 125. Additionally, in that example, the release tab 310 is positioned within or beneath the body 125. The cup holding unit 110 includes one release tab 310 for each suction cup 215 and/or one release tab 310 that disengages multiple the suction cups 215.

Figures 8, 9, 10:
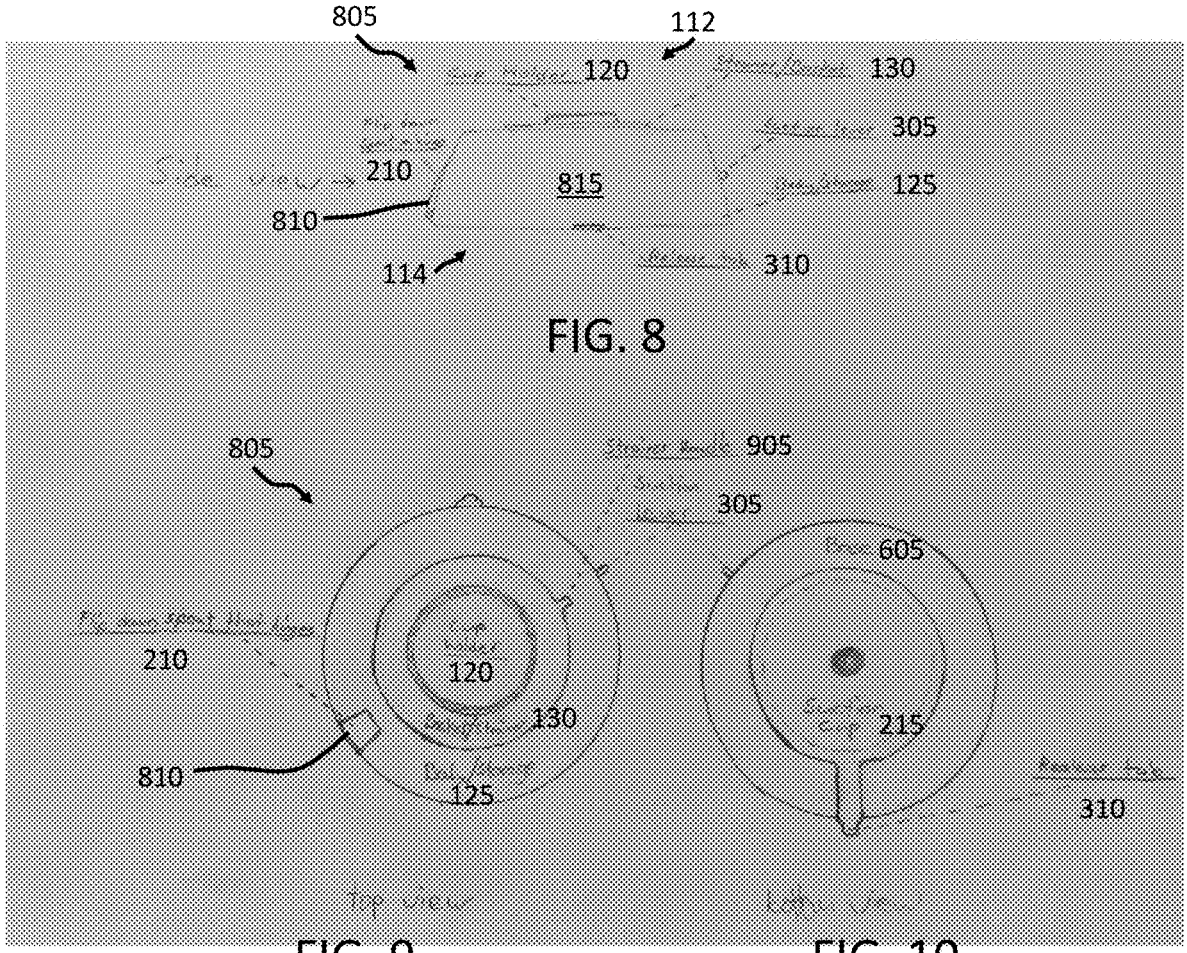
FIG. 8 is a side view of an alternate version of the FIG. 2 cup holding unit.
FIG. 9 is a top view of the FIG. 8 cup holding unit.
FIG. 10 is a bottom view of the FIG. 8 cup holding unit.

FIGS. 8, 9 and 10 illustrate a cup holding unit 805, another example of the cup holding unit 110. The cup holding unit 805 generally includes the same components as the cup holding unit 110. For example, the cup holding unit 805 includes the cup holder 120, the body 125, and the basket 130. The cup holding unit 805 is generally used in the same way as the cup holding unit 110. As shown, the cup holding unit 805 has a generally cylindrical shape and circular cross-section rather than the oval shape of the cup holding unit 110, shown in FIGS. 1-7. Further, the cup holding unit 805 includes the suction cup 215, the release tab 310, the first diameter 315, and the spout 210. In one version, the cup holder 120 and/or the basket 130 are removable from the body 125. As should be appreciated, the cup holding unit 805 utilizes any combination of features described for the cup holding unit 110 in the preceding figures. Further, the cup holding unit 110 is configured to utilize any combination of features from the cup holding unit 805.

As illustrated, the spout 210 on the cup holding unit 805 is in the form of a flip-out spout 810. The flip-out spout 810 is generally configured to rotate relative to the body 125. When the flip-out spout 810 is rotated out from the body 125, the flip-out spout 810 allows caught liquid to flow out from the cup holding unit 805. In one version, the flip-out spout 810 allow liquid to flow from the perforation 225 in the basket 130. In another version, the flip-out spout 810 allows liquid to flow from the cavity 405 in the body 125. When the flip-out spout 810 is rotated into the body 125, the flip-out spout 810 prevents liquid from flowing out of the side of the body 125. By selectively opening and closing the flip-out spout 810, users can open the flip-out spout 810 only when deliberately emptying the contained liquid from the cup holding unit 805. This allows the flip-out spout 810 to remain closed during pouring and/or when the cup holding unit 805 is moved. Closing the flip-out spout 810 during such times ensures that liquid does not escape the cup holding unit 805 through the flip-out spout 810 and create a mess. Further, the flip-out spout 810 allows the cup holding unit 805 to be drained without tilting the cup holding unit 805. Draining the cup holding unit 805 without having to tilt or move the cup holding unit 805 allows the liquid to be disposed in a controlled way with a low risk of spilling.

The cup holding unit 805 further includes a side wall 815. The side wall 815 is generally formed as a part of the body 125. The side wall 815 extends around a circumference of the cup holding unit 805 and covers the lateral sides of the cup holding unit 805. In contrast, the version of the cup holding unit 110 shown in FIGS. 1-7 does not include the side wall 815. In another version, the body 125 in the cup holding unit 110 includes the side wall 815. The side wall 815 generally encloses the sides of the cup holding unit 805. In one example, the side wall 815 provides an enclosed space for storage. In another example, the side wall 815 provides an enclosed space that contains various mechanisms for the suction lever 305, the release tab 310, and/or the flip-out spout 810. In one version, the side wall 815 and the base 605 together fully enclose the space. In another version, the base 605 does not fully enclose the space from the bottom side 114. Further, the side wall 815 provides additional stability. By extending all or most of the way to the bottom side 114, the side wall 815 helps prevent the cup holding unit 805 from tipping over when pushed from the side.

As shown in FIGS. 9 and 10, the basket 130 includes a handle 905. The handle 905 allows a user to easily grab and lift the basket 130. In one version, the basket 130 includes perforations, as shown in FIG. 2, and allows liquid to drain into the cavity 405 on in the body 125. The handle 905 allows a user to easily lift and remove the basket 130 to be cleaned. In another version, the basket 130 retains spilled liquid. The handle 905 allows a user to lift and remove the basket 130 to empty the spilled liquid from the basket 130. In another example, the cup holder 120 and/or the body 125 include the handle 905.

As shown in FIG. 10, the cup holding unit 805 includes one suction cup 215 that extends across a large portion of the base 605. In the illustrated example, the base 605 extends across the entire bottom side 114 on the cup holding unit 805. In one version, the base 605 is fixed to and not toolessly detachable from the body 125. The release tab 310 extends from the suction cup 215. In the illustrated example, the release tab 310 is formed as a part of the suction cup 215. Pulling and/or lifting the release tab 310 separates the edge of the suction cup 215 from a tabletop or other surface. This causes the suction cup 215 to release from the surface. Using a single suction cup 215 allows the cup holding unit 805 to utilize a single release tab 310 in this form. As should be appreciated, the cup holding unit 805 is configured to utilize any type, number, and/or arrangement of the suction cups 215, such as any of the arrangements shown in FIGS. 6 and 7. Further, the cup holding unit 805 is configured to utilize any form of the base 605 and body 125.

Figure 11:
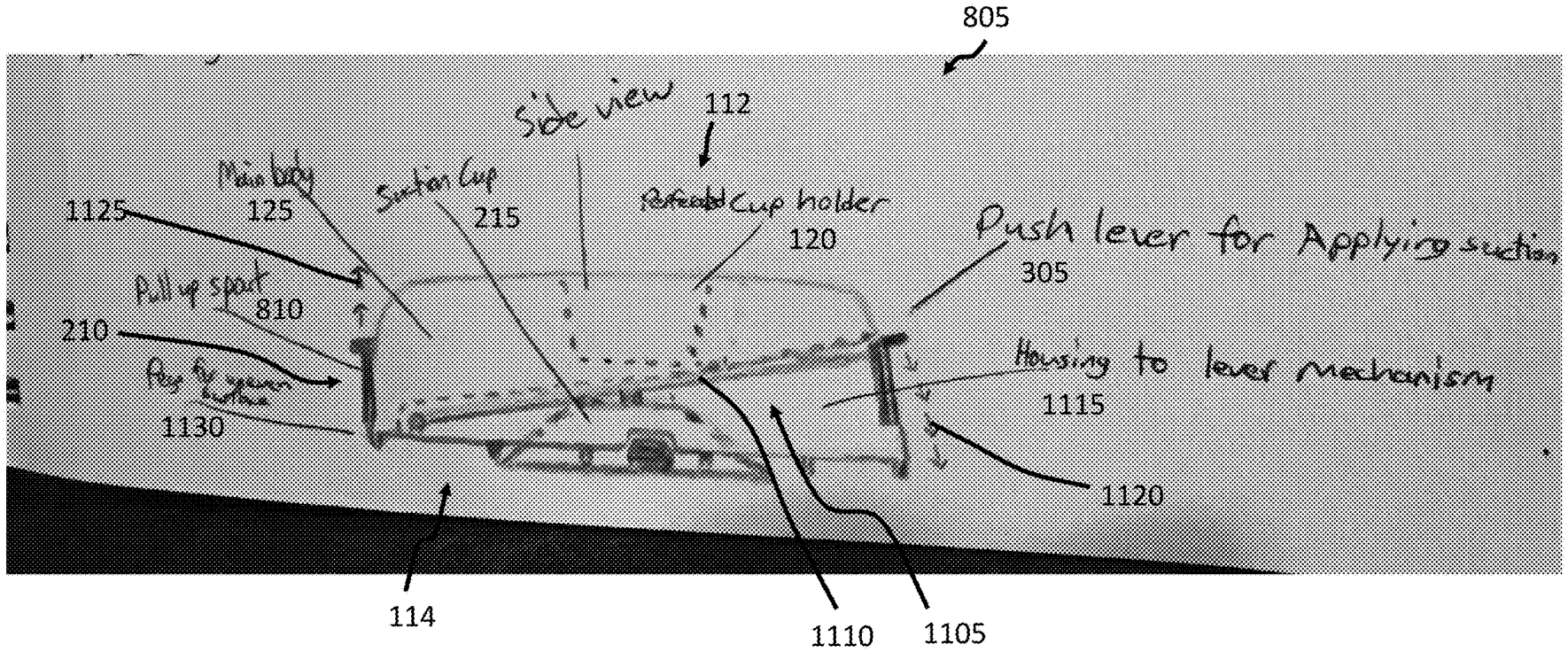
FIG. 11 is a side view of the FIG. 8 cup holding unit showing an interior of the cup holding unit.

Referring to FIG. 11, the cup holding unit 805 includes a suction cup mechanism 1105 configured to engage the suction cup 215. The dashed lines in FIG. 11 represent the shape of components on the interior of the cup holding unit 805. For example, the outline of the cup holder 120 is depicted in dashed lines. As shown, the suction cup mechanism 1105 is positioned at least partially within the body 125. The side wall 815 partially encloses a space for the suction cup mechanism 1105. The suction cup mechanism 1105 generally includes an applicator plate 1110, a housing 1115, and the suction lever 305. The applicator plate 1110 is typically a flat plate or strut that depresses the suction cup 215 when the suction lever 305 is pushed. In one example, the base 605 is used as the applicator plate 1110. The applicator plate 1110 is rotatably fixed at one end, such as through a hinge. The suction lever 305 is attached to the other end of the applicator plate 1110. When the suction lever 305 is pressed in the direction of arrows 1120, the applicator plate 1110 rotates about the hinged end. The applicator plate 1110 pushes suction cup 215 toward the bottom side 114. When the cup holding unit 805 is positioned on a table, the pushing causes the suction cup 215 to engage with the table and form a seal.

The housing 1115 contains the components of the suction cup mechanism 1105 within the body 125. In one example, the housing 1115 is partially formed by the side wall 815 and/or another portion of the body 125. The housing 1115 separates the suction cup mechanism 1105 from other mechanisms in the cup holding unit 805. For example, the housing 1115 separates components of the suction cup mechanism 1105 from components of the flip-out spout 810 on the interior of the body 125. In one version, the suction cup mechanism 1105 is separate unit that is fully contained in the housing 1115 and installed in the cup holding unit 805.

As illustrated, the flip-out spout 810 is biased in the direction of arrows 1125. The flip-out spout 810 is generally in a closed and locked state when positioned toward the top side 112. Biasing the flip-out spout 810 toward the top side 112 ensures that the flip-out spout 810 remains in the closed state by default. In the locked state, the flip-out spout 810 is blocked from rotating out of the body 125. This prevents the flip-out spout 810 from accidentally rotating out from the body 125 and allowing liquid to escape when not intended by the user. When the flip-out spout 810 is pushed against the direction of arrows 1125, the flip-out spout 810 generally becomes unlocked. In the unlocked state, a user is able to rotate the flip-out spout 810 away from the body 125 to allow liquid to drain.

In one example, the cup holder 120 is formed with the body 125 and/or permanently fixed the body 125. As shown in FIG. 11, the cup holder 120 extends into the body 125 toward the bottom side 114. The cavity 405 defined by the body 125 generally extends around the circumference of the cup holder 120. In one version, the cup holder 120 includes perforations to allow liquid to drain into the body 125 and/or the basket 130.

In the FIG. 11 example, the cup holding unit 805 further includes support pegs 1130 positioned on the bottom side 114. The support pegs 1130 extend from the body 125. Particularly, the support pegs 1130 extend from the side wall 815 at various points along the perimeter of the cup holding unit 805. The support pegs 1130 provide support for the body 125 at various points. Further, the support pegs 1130 ensure that the body 125 is oriented level with respect to the tabletop and/or other surface on which the cup holding unit 805 is positioned.

Figure 12:
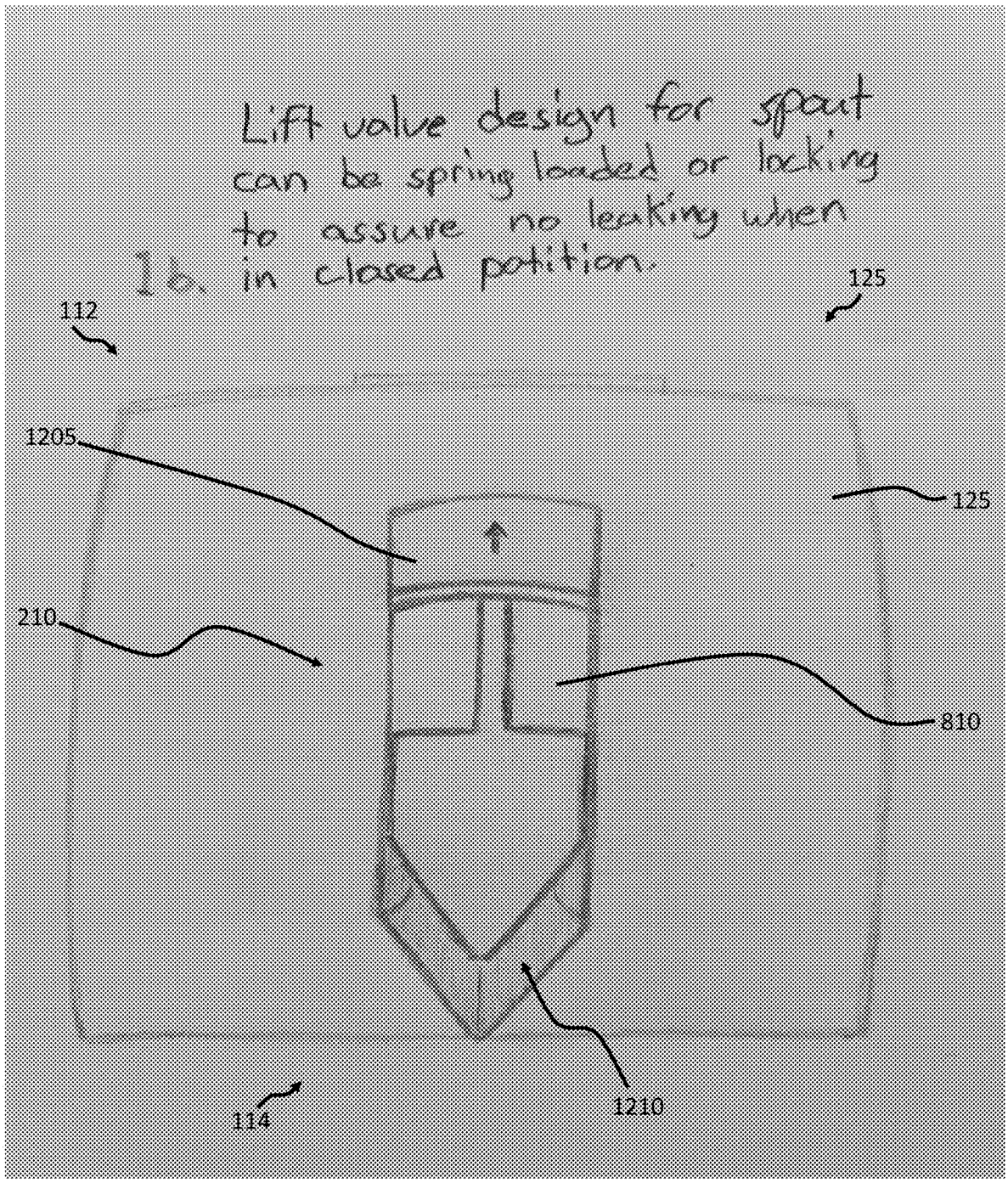
FIG. 12 is a front view of a flip-out spout from the FIG. 8 cup holding unit.

Referring to FIG. 12, the flip-out spout 810 includes a lift valve 1205. The lift valve 1205 is configured to form a seal between the flip-out spout 810 and the body 125 to prevent liquid from escaping the body 125. The lift valve 1205 forms the seal when the flip-out spout 810 is positioned toward the top side 112. As shown in FIG. 11, the flip-out spout 810 is biased toward the top side 112 to allow the lift valve 1205 to maintain the seal by default. In one example, the flip-out spout 810 is spring loaded to bias the lift valve 1205 closed. In another example, the flip-out spout 810 has a separate lock for a user to manually keep the lift valve 1205 closed. As illustrated, the body 125 defines a spout recess 1210 to receive the flip-out spout 810. The spout recess 1210 generally extends beyond the size of the flip-out spout 810 to allow the flip-out spout 810 to slide between the top side 112 and the bottom side 114. To open the lift valve 1205, a user can slide the flip-out spout 810 toward the bottom side 114 and into the unfilled portion of the spout recess 1210. Moving the flip-out spout 810 in this way allows the flip-out spout 810 to then be rotated out from the body 125 and for liquid to drain through the flip-out spout 810.

Figure 13:
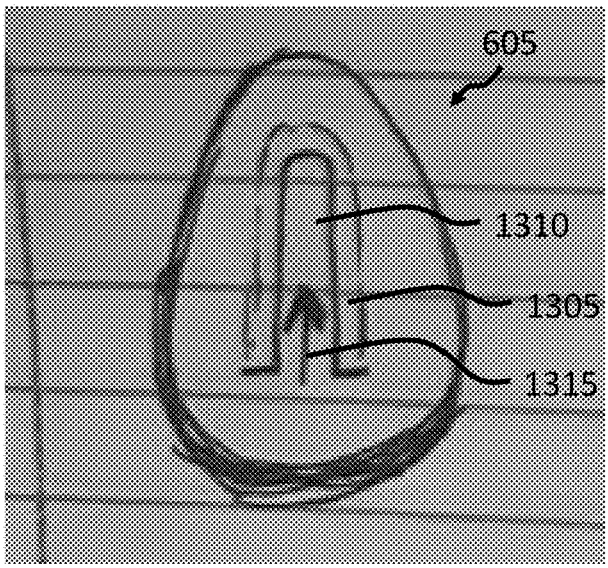
FIG. 13 is a top view of an alternate version of the FIG. 6 base.
Figure 14:
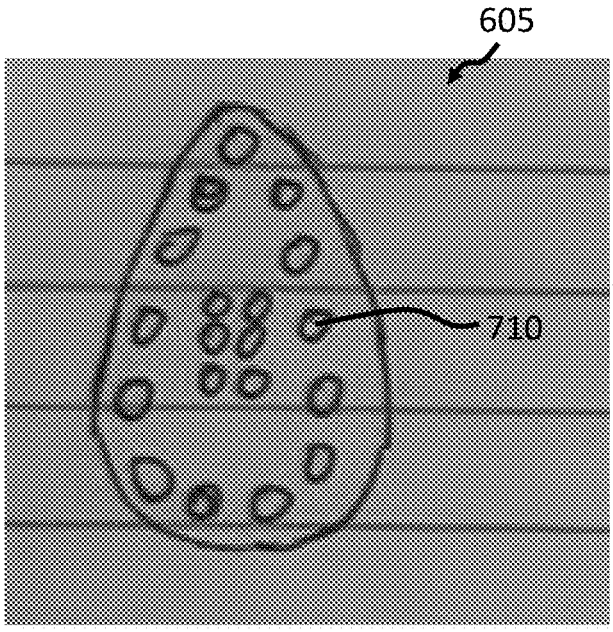
FIG. 14 is a bottom view of the FIG. 13 base.
Figure 15:
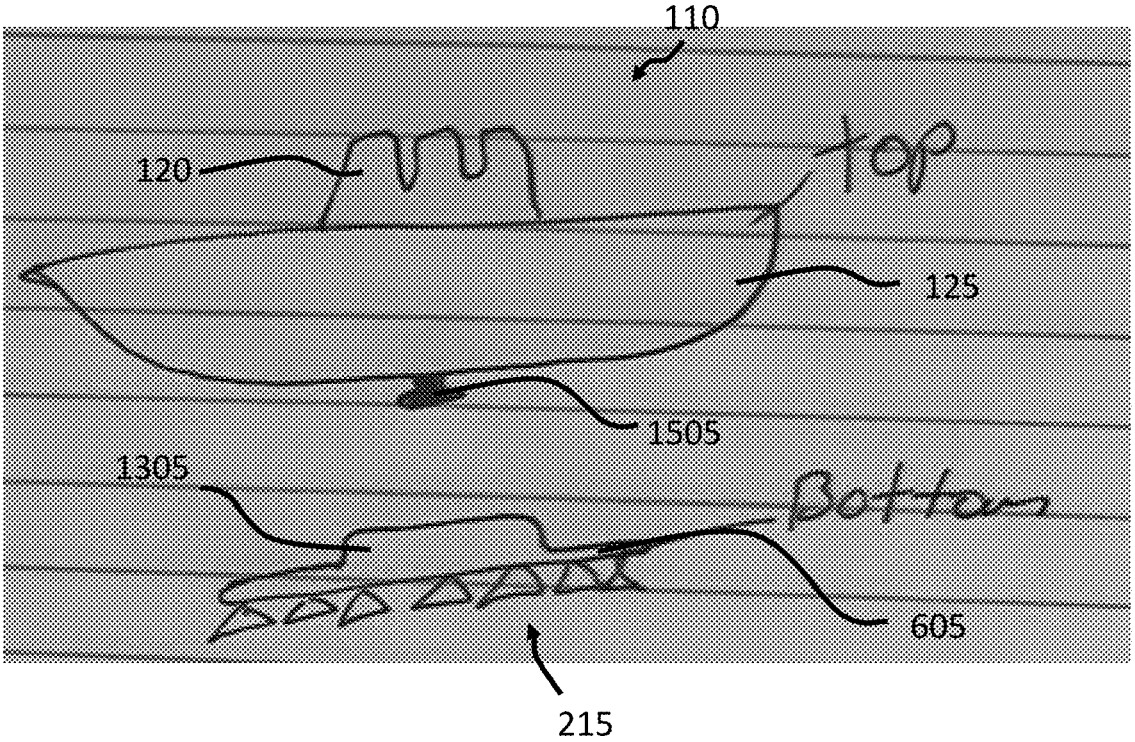
FIG. 15 is an exploded view of a version of the FIG. 2 cup holding unit that includes the FIG. 14 base.

FIGS. 13, 14, and 15 depict an alternate version of the cup holding unit 110. In the FIG. 13 example, the base 605 includes a ridge 1305. The ridge 1305 extends from the top of the base 605 and supports toolessly attaching the base 605 to the body 125. The ridge 1305 defines a channel 1310. The channel 1310 extends out one end of the ridge 1305. This allows a portion of the body 125 to slide into the ridge 1305 in the direction of arrow 1315. As noted, sliding the body 125 to attach and detach from the base 605 allows the user to avoid shaking and tilting the cup holding unit 110.

In the FIG. 15 example, the body 125 includes a knob 1505. The knob 1505 protrudes from the bottom of the body 125. The knob 1505 is shaped to slide into the channel 1310 and to hold the body 125 against the base 605. For example, the knob 1505 has a narrow portion leading to a wider portion on the end. The ridge 1305 secures the knob 1505 against the base 605 when the knob 1505 is positioned in the channel 1310. As should be appreciated, the cup holding unit 110 shown in FIGS. 1-7 and the cup holding unit 805 shown in FIGS. 8-12 are configured to utilize and incorporate any components described in the FIGS. 13-15 example.

In the FIGS. 14 and 15 example, the base 605 includes suction cups 215 in the form of the small suction cups 710. As shown in FIG. 14, the small suction cups 710 are arranged in a grid pattern in the center of the base 605. For instance, the small suction cups 710 are arranged in two rows of three small suction cups 710. Further, the small suction cups 710 are arranged around the perimeter of the base 605. Using multiple small suction cups 710 dispersed in such a pattern allows the suction force to be distributed evenly along the base 605. As should be appreciated, the cup holding unit 110 shown in FIGS. 1-7 and the cup holding unit 805 shown in FIGS. 8-12 are configured to utilize the number, size, and arrangement of suction cups 215 as shown in FIGS. 14 and 15.

Figure 16:
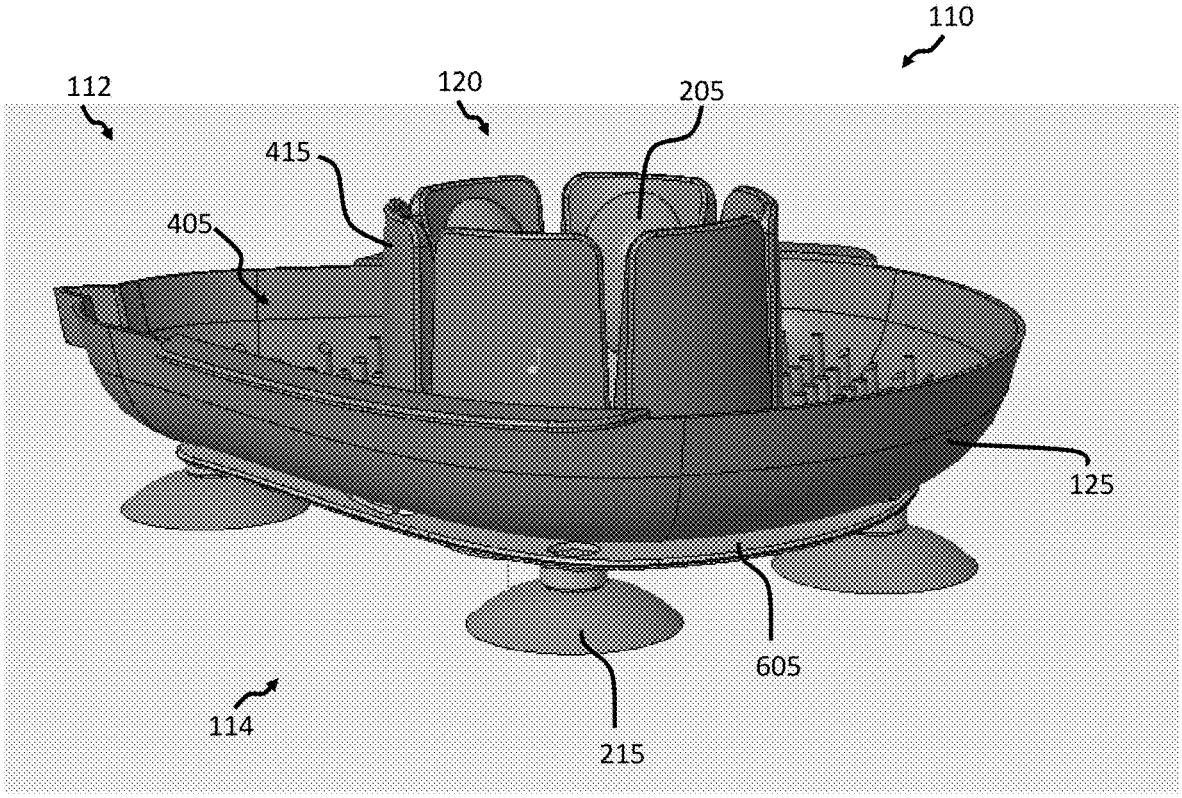
FIG. 16 is a perspective view of another alternate version of the FIG. 2 cup holding unit.
Figure 17:
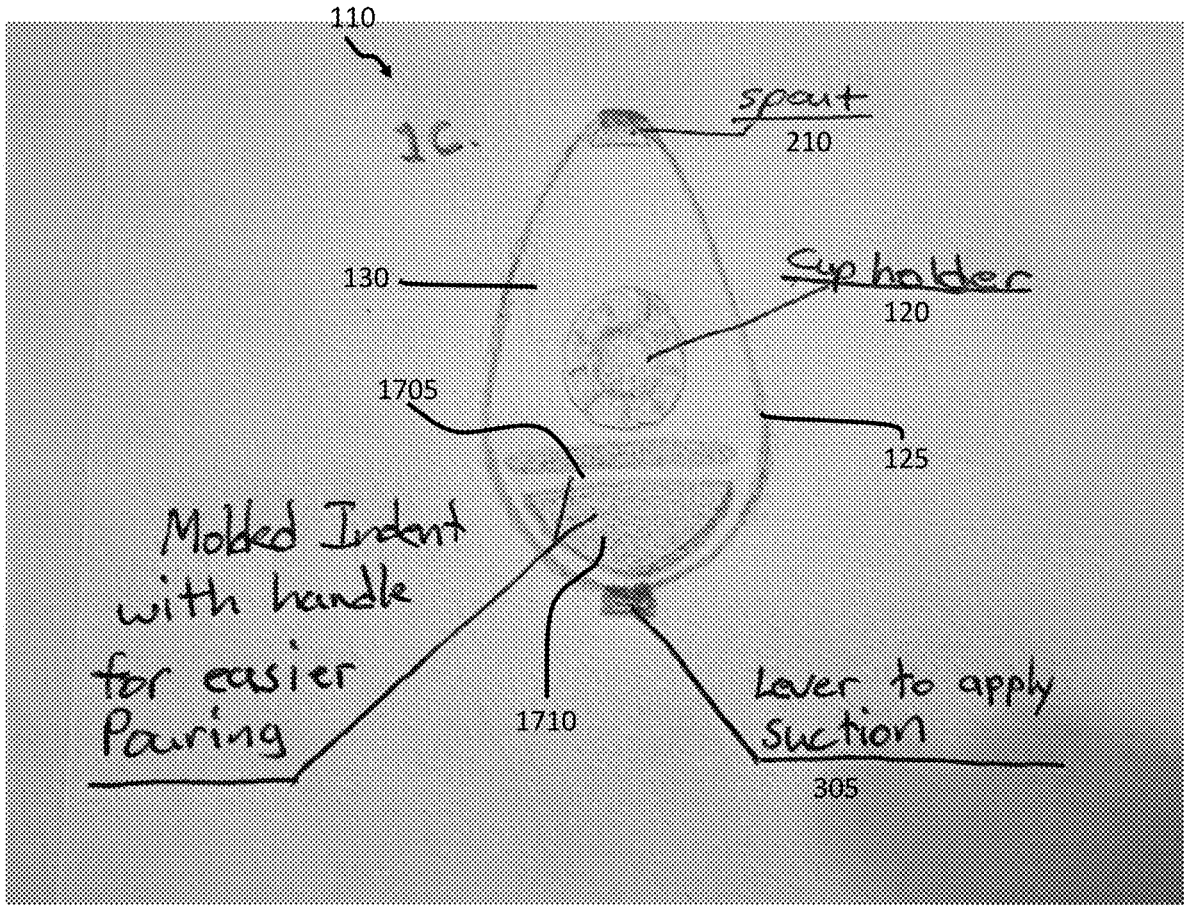
FIG. 17 is a top view of yet another alternate version of the FIG. 2 cup holding unit.

FIGS. 16 and 17 depict additional alternate versions of the cup holding unit 110. As should be appreciated, the cup holding unit 110 shown in FIGS. 1-7 and the cup holding unit 805 shown in FIGS. 8-12 are configured to incorporate any combination of features from the FIGS. 16 and 17 examples. In the FIG. 16 example, the cup holder 120 is integrated with the body 125. As shown, the cup support 415 on the body 125, also shown in FIG. 4, forms the main structure of the cup holder 120. The pads 205 are attached to the cup support 415. For instance, each segment of the cup support 415 has one pad 205 attached. Further, the gaps between the segments of the cup support 415 allow liquid to drain from the cup holder 120 into the cavity 405.

In the FIG. 17 example, the cup holding unit 110 includes a handle 1705. The handle 1705 generally allows the user to grab and lift the cup holding unit 110, such as for pouring liquid out the spout 210. The cup holding unit 110 defines a handle cavity 1710 around the handle 1705. The handle cavity 1710 provides space for the hand of the user to grab the handle 1705. In one version, the handle 1705 is formed by the body 125. Generally, the handle 1705 is used for moving and/or tilting the entire cup holding unit 110. In another version, the handle 1705 is formed by the basket 130. In that version, the handle 1705 assists users to remove the basket 130 from the body 125.

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"Adhesive" generally refers to any non-metallic substance applied to one or both surfaces of two separate parts that binds them together and resists their separation. For example, an adhesive can bond both mating surfaces through specific adhesion (e.g, molecular attraction), through mechanical anchoring (e.g, by flowing into holes in porous surfaces), and/or through fusion (e.g, partial solution of both surfaces in the adhesive or its solvent vehicle). Some non-limiting examples of adhesives include liquid adhesives, film adhesives, resin adhesives, rubber adhesives, silicone-based adhesives, mastics, metal-to-metal adhesives, plastic adhesives, rubber adhesives, sprayable adhesives, and hot melt adhesives, to name just a few.

"And/Or" generally refers to a grammatical conjunction indicating that one or more of the cases it connects may occur. For instance, it can indicate that either or both of the two stated cases can occur. In general, "and/or" includes any combination of the listed collection. For example, "X, Y, and/or Z" encompasses: any one letter individually (e.g, {X}, {Y}, {Z}); any combination of two of the letters (e.g, {X, Y}, {X, Z}, {Y, Z}); and all three letters (e.g, {X, Y, Z}). Such combinations may include other unlisted elements as well.

"Cavity" generally refers to an empty space in a solid object. The cavity can be completely or partially surrounded by the solid object. For example, the cavity can be opened to the surrounding environment.

"Channel" generally refers to a long, narrow groove in a surface of an object.

A "Friction Fit" or "Interference Fit" or "Pressed Fit" generally refers to a type of coupling between two parts. Typically, the two parts fit tightly against each other. One or more segments of the parts are configured to interact. In some examples, one part defines a hole and/or opening configured to receive a portion of the other part. The tolerance between interacting segments of the parts is typically low, such as below 1 millimeter, 100 micrometers, 10 micrometers, and/or another width. Frictional force between the parts is configured to hold the parts together in a friction fit. In some cases, the parts are pressed together to create a friction fit. In another example, the parts can form a friction fit through expansion and/or contraction of one of the parts, such as due to temperature changes and/or other deformation. A friction fit can be reversible and allow the parts to be repeatedly coupled and decoupled, or the friction fit can permanently couple the two parts.

"Handle" generally refers to a part that is designed especially to be grasped by a human hand. In other words, a handle is a part by which an object, such as a tool or device, is held, carried, and/or controlled by a human hand. A handle typically has sufficient strength to support the object. For tools, the handle typically has sufficient strength to transmit any force from the handle to perform the designed functionality for the tool. The handle usually has a sufficient length to accommodate a single hand or multiple hands to grip and reliably exert force through the handle. Similarly, the handle commonly has a sufficiently small circumference or exterior size to permit single hand or multiple hands to reliably grip the handle. Other ergonomic factors, such friction, coating, grip, and injury prevention features, can be incorporated into the handle. By way of non-limiting examples, the handles can include broom handles, shovel handles, pull handles, or twist handles, to name just a few.

"Housing" generally refers to a component that covers, protects, or supports another thing. For example, the casing of a desktop computer is its housing component and can be made of multiple materials to protect the internal component.

"Liquid" generally refers to a fluid that has no independent shape but has a definite volume and does not expand indefinitely and that is only slightly compressible.

"Locking Means" means here any device used to connect one object to another, (and/or inside a hole), and that holds the objects from being separated. This may include for example, tab(s), bayonet(s), thread(s), snap(s), detent(s), a flange, and/or combinations thereof.

"Opening" generally refers to a space or slot that something can pass through and/or be placed into.

"Pin" or "Peg" generally refers to an elongated piece of material such as wood, metal, plastic and/or other material. Typically (but not always), the pin is tapered at one or both ends, but the pin can be shaped differently in other examples. For example, the ends of the pin can be flattened, widened, and/or bent in order to retain the pin. Pins can be used for any number of purposes. For example, the pin can be used in machines to couple components together or otherwise act as an interface between components. Pins can also be used for holding things together, hanging things on, and/or marking a position. Normally, but not always, the pin is a small, usually cylindrical piece. In certain cases, the pin is pointed and/or a tapered piece used to pin down, fasten things together, and/or designed to fit into holes. In other examples, the pin can have a polyhedral shape, such as with a rectangular or triangular cross-sectional shape, or an irregular shape.

"Plastic" generally refers to a group of materials, either synthetic, semi-synthetic, and/or naturally occurring, that may be shaped when soft and then hardened to retain the given shape. Plastics are polymers. A polymer is a substance made of many repeating units. Plastics are generally insulators.

"Snap-Fit Connector" or "Snap-Fit Connection" generally refers to a type of attachment device including at least two parts, with at least one of which being flexible, that are interlocked with one another by pushing the parts together. The term "Snap-Fit Connector" may refer to just one of the parts, such as either the protruding or mating part, or both of the parts when joined together. Typically, but not always, the snap-fit connector includes a protrusion of one part, such as a hook, stud, and/or bead, that is deflected briefly during the joining operation and catches in a depression and/or undercut in the mating part. After the parts are joined, the flexible snap-fit parts return to a stress-free condition. The resulting joint may be separable or inseparable depending on the shape of the undercut. The force required to separate the components can vary depending on the design. By way of non-limiting examples, the flexible parts are made of a flexible material such as plastic, metal, and/or carbon fiber composite materials. The snap-fit connectors can include cantilever, torsional, and/or annular type snap-fit connectors. In the annular snap-fit type connector, the connector utilizes a hoop-strain type part to hold the other part in place. In one form, the hoop-strain part is made of an elastic material and has an expandable circumference. In one example, the elastic hoop-strain part is pushed onto a more rigid part so as to secure the two together. Cantilever snap-fit type connectors can form permanent type connections or can be temporary such that the parts can be connected and disconnected multiple times. A multiple use type snap-fit connector typically, but not always, has a lever or pin that is pushed in order to release the snap-fit connection. For a torsional snap-fit connector, protruding edges of one part are pushed away from the target insertion area, and the other part then slides in between the protruding edges until a desired distance is reached. Once the desired distance is reached, the edges are then released such that the part is held in place.

"Tab" generally refers to a projection, flap, or strip of material that extends from an object or structure.

"Toolless" generally refers to an activity not having and/or requiring tools in order to perform the activity. Typically, the act can be performed manually by an individual.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

| Reference Numbers | |
|---|---|
| 100 | system |
| 105 | cup |
| 110 | cup holding unit |
| 112 | top side |
| 114 | bottom side |
| 115 | pitcher |
| 120 | cup holder |
| 125 | body |
| 130 | basket |
| 205 | pad |
| 210 | spout |
| 215 | suction cup |
| 220 | spill area |
| 225 | perforation |
| 305 | suction lever |
| 310 | release tab |
| 315 | first diameter |
| 320 | second diameter |
| 405 | cavity |
| 410 | peg |
| 415 | cup support |
| 420 | flange |
| 505 | shell |
| 510 | stabilizer |
| 605 | base |
| 610 | large suction cup |
| 615 | tab |
| 620 | slot |
| 705 | attachment stem |
| 710 | small suction cup |
| 805 | cup holding unit |
| 810 | flip-out spout |
| 815 | side wall |
| 905 | handle |
| 1105 | suction cup mechanism |
| 1110 | applicator plate |
| 1115 | housing |
| 1120 | arrow |
| 1125 | arrow |
| 1130 | support peg |
| 1205 | lift valve |
| 1210 | spout recess |
| 1305 | ridge |
| 1310 | channel |
| 1315 | arrow |
| 1505 | knob |
| 1705 | handle |
| 1710 | handle cavity |

What is claimed is:

1. A system, comprising:
a cup holding unit including
a body defining a cavity,
a cup holder positioned on the body,
wherein the cup holder is configured to receive a cup,
a basket positioned in the cavity on the body,
wherein the basket is removable from the cavity on the body,
wherein the basket extends around the cup holder,
wherein the basket is configured to catch liquid that spills when pouring into the cup, a suction cup positioned under the body, and
wherein the suction cup is configured to secure the body in place against a surface during pouring.

2. The system of claim 1, wherein:
the basket defines multiple perforations; and
the perforations allow liquid to drain from the basket into the cavity on the body.

3. The system of claim 1, wherein:
the body includes multiple pegs extending into the cavity; and
the pegs are configured to disrupt the flow of liquid to inhibit the liquid from splashing.

4. The system of claim 1, further comprising:
a base attached on a bottom side of the body;
wherein the base is toollessly attachable and detachable from the body; and
wherein the suction cup is mounted to the base.

5. The system of claim 4, wherein:
the base defines slots;
the body includes tabs;
the tabs slide into the slots when the body is rotated relative to the base; and
the body is secured against the base when the tabs are positioned in the slots.

6. The system of claim 1, further comprising:
a suction lever; and
wherein the suction lever engages the suction cup against the surface when pressed.

7. The system of claim 1, further comprising:
a release tab; and
wherein the release tab disengages the suction cup from the surface when pulled.

8. A system, comprising:
a cup holding unit including
a body defining a cavity,
a cup holder positioned on the body,
wherein the cup holder is configured to receive a cup,
a basket positioned in the cavity on the body,
wherein the basket is removable from the cavity on the body,
wherein the basket extends around the cup holder,
wherein the basket is configured to catch liquid that spills when pouring into the cup,
a base mounted to multiple suction cups,
wherein one or more of the suction cups are arranged along a perimeter of the bases, and
wherein one or more of the suction cups are arranged near a center of the base.

9. The system of claim 8, wherein the suction cups near the center are arranged in a hexagon pattern.

10. The system of claim 8, wherein the suction cups near the center are arranged in a rectangular grid pattern.

11. A system, comprising:
a cup holding unit including
a body defining a cavity,
a cup holder positioned on the body,
wherein the cup holder is configured to receive a cup,
a basket positioned in the cavity on the body,
wherein the basket extends around the cup holder,
wherein the basket is configured to catch liquid that spills when pouring into the cup,
a spout positioned on the body,
wherein the spout is rotatable from the body,
wherein the spout allows liquid to flow when rotated away from the body, and
wherein the spout prevents liquid from flowing when rotated into the body.

12. The system of claim 11, wherein:
the body defines a spout cavity;
the spout is positioned in the spout cavity on the body;
the spout cavity provides space for the spout to move in a vertical direction between a top side and a bottom side; and
the spout is locked from rotating away from the body when the spout is positioned toward the top side of the body within the spout cavity.

13. The system of claim 12, wherein:
the spout includes a lift valve; and
the lift valve prevents liquid from flowing through the spout when the spout is positioned toward the top side of the body within the cavity.

14. The system of claim 12, wherein the spout is spring-biased toward the top side of the body.

15. The system of claim 11, further comprising:
a suction cup positioned under the body; and
wherein the suction cup is configured to secure the body in place against a surface during pouring.

16. The system of claim 15, further comprising:
a suction lever; and
wherein the suction lever engages the suction cup against the surface when pressed.

17. The system of claim 15, further comprising:
a release tab; and
wherein the release tab disengages the suction cup from the surface when pulled.

18. The system of claim 15, further comprising:
a base attached on a bottom side of the body;
wherein the suction cup is mounted to the base; and
wherein the base is toollessly attachable and detachable from the body.

19. The system of claim 18, wherein:
the base is mounted to multiple suction cups;
one or more of the suction cups are arranged near a center of the base; and
one or more of the suction cups are arranged along a perimeter of the base.

* * * * *